US010422219B2

(12) United States Patent
Owen et al.

(10) Patent No.: US 10,422,219 B2
(45) Date of Patent: Sep. 24, 2019

(54) FREQUENCY HOPPING SOUNDER SIGNAL FOR CHANNEL MAPPING AND EQUALIZER INITIALIZATION

(71) Applicant: HALLIBURTON ENERGY SERVICES, INC., Houston, TX (US)

(72) Inventors: Henry Spyker Owen, Medford, NJ (US); Bipin Kumar Pillai, Sugar Land, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/116,016

(22) PCT Filed: Jul. 24, 2015

(86) PCT No.: PCT/US2015/042140

§ 371 (c)(1),
(2) Date: Aug. 2, 2016

(87) PCT Pub. No.: WO2017/019003

PCT Pub. Date: Feb. 2, 2017

(65) Prior Publication Data

US 2017/0167251 A1 Jun. 15, 2017

(51) Int. Cl.
*E21B 47/18* (2012.01)

(52) U.S. Cl.
CPC ..... *E21B 47/18* (2013.01); *E21B 47/182* (2013.01)

(58) Field of Classification Search
CPC ..... E21B 47/18
See application file for complete search history.

(56) References Cited

U.S. PATENT DOCUMENTS 4,858,130 A * 8/1989 Widrow ..... E21B 43/26 166/250.09
5,955,966 A * 9/1999 Jeffryes ..... E21B 47/12 175/40

(Continued)

FOREIGN PATENT DOCUMENTS

WO 2012027633 A2 3/2012

OTHER PUBLICATIONS

International Search Report and Written Opinion dated Mar. 29, 2016 in International Application No. PCT/US2015/042140.

(Continued)

*Primary Examiner* — Quang Pham
(74) *Attorney, Agent, or Firm* — Polsinelli PC

(57) ABSTRACT

A system for channel sounding and initializing an equalizer using a frequency hopping sounder signal. The system identifies a frequency range for sounding a channel between a first device at a first location within a wellbore and a second device at a second location within the wellbore. Center frequencies, bandwidths, and timeframes are assigned to each of a plurality of sounding sequences, such that an entirety of the frequency range is assigned to the plurality of sounding sequences, and wherein when played in order according to the timeframe assigned to each sounding sequence in the plurality of sounding sequences, a sounding signal having a non-contiguous frequency is produced. By comparing an attenuated sounding signal based on the sounding signal to the sounding signal, the system estimates a transfer function of the channel. The system also initializes the equalizer based on the comparison.

23 Claims, 7 Drawing Sheets

(56) References Cited

U.S. PATENT DOCUMENTS 6,151,554 A * 11/2000 Rodney ..... G01V 1/42 702/17
8,391,234 B2 * 3/2013 Nouda ..... H04J 11/00 370/330
2005/0041574 A1 2/2005 Wu et al.
2006/0285579 A1 * 12/2006 Rhee ..... H04B 1/7156 375/132
2007/0132606 A1 * 6/2007 Reckmann ..... E21B 47/18 340/855.4
2007/0201308 A1 * 8/2007 Wassermann ..... E21B 47/18 367/82
2008/0019314 A1 * 1/2008 Gorokhov ..... H04B 1/7075 370/330
2010/0197264 A1 8/2010 Azadet et al.
2010/0260275 A1 10/2010 Talley et al.
2011/0080935 A1 * 4/2011 Kim ..... H04B 1/7143 375/133
2011/0116436 A1 * 5/2011 Bachu ..... H04L 5/0048 370/312
2011/0294529 A1 * 12/2011 Luo ..... H04L 5/0035 455/509
2012/0013481 A1 * 1/2012 Clark ..... E21B 47/12 340/854.3
2012/0068867 A1 * 3/2012 Pagnanelli ..... H03M 3/468 341/120
2012/0313742 A1 * 12/2012 Kurs ..... B60L 53/52 336/180
2013/0096922 A1 * 4/2013 Asaei ..... G01S 3/8006 704/270
2013/0223663 A1 * 8/2013 Roos ..... H04R 25/55 381/315
2013/0308685 A1 * 11/2013 Nagai ..... H04W 72/02 375/133
2014/0079248 A1 * 3/2014 Short ..... G10L 21/0272 381/119
2015/0156756 A1 * 6/2015 Zhang ..... H04W 68/00 370/336
2015/0304006 A1 * 10/2015 Ro ..... H04B 7/0684 370/329
2015/0345287 A1 * 12/2015 White ..... E21B 47/182 367/83

OTHER PUBLICATIONS

Office Action; Canadian Application No. 2,989,299; dated Oct. 4, 2018.

* cited by examiner

FREQUENCY HOPPING SOUNDER SIGNAL FOR CHANNEL MAPPING AND EQUALIZER INITIALIZATION

CROSS-REFERENCE TO RELATED APPLICATIONS

This application is a national stage entry of PCT/US2015/042140 filed Jul. 24, 2015, said application is expressly incorporated herein in its entirety.

TECHNICAL FIELD

The present disclosure relates to channel mapping of a downhole channel associated with drilling operations, and more specifically to generation of a frequency hopping sounder signal for channel mapping the downhole mud column and equalizer initialization using the frequency hopping sounder signal.

BACKGROUND

Communication between the surface and a downhole tool is often conducted during drilling or other oil and gas operations via mud pulse. When transmitting pressure signals from downhole to the surface or from the surface to a downhole transducer, the mud channel causes distortion and attenuation which can impact signal quality. For example, frequency selective fading, where nulls appear in certain parts of the spectrum, can occur because of reflections of signals along the propagation path, the equipment at the surface, changes in characteristics of an channel through the pipe, and/or from the various elements in the bottom hole assembly. Additionally, there is an attenuation that occurs as a function of frequency (higher frequencies are attenuated more) due to the characteristics of the mud in the column.

A system designed to permit communications through this mud channel might adapt in two ways. First such a system may select optimal frequencies in which to operate based on an understanding of the nulls that appear in the spectrum from the channel. In this way, the center frequency of a passband modulation (such as QPSK (Quadrature Phase Shift Keying), BPSK (Binary Phase Shift Keying), MSK (Minimum Shift Keying), SOQPSK (Shaped Offset Quadrature Shift Keying), CPM (Continuous Phase Modulation), QAM (Quadrature Amplitude Modulation), or others) may be adjusted so that no nulls occur in the signal's frequency range, and so that the center frequency is not too high considering the mud column attenuation effects. This can be considered a channel mapping function. Second, equalizers can be employed to reduce the distortion effects of frequency selective fading. Often when equalizers are used, methods are employed to rapidly initiate the equalizers so that they can rapidly converge to a state where the distortion in the channel is largely mitigated.

DETAILED DESCRIPTION

Figure 1:
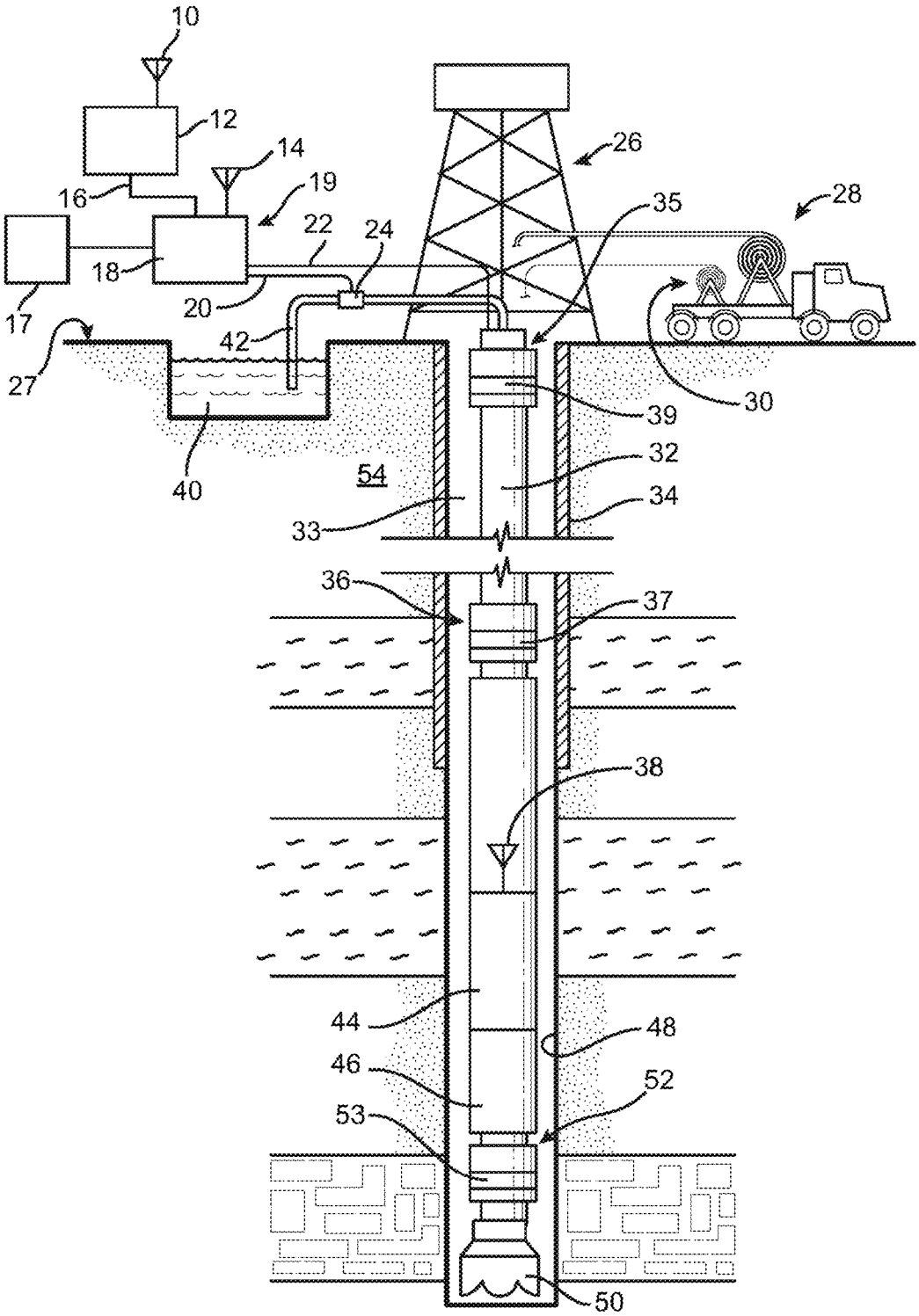
FIG. 1 illustrates a schematic diagram of a system for well logging while drilling a wellbore.

Various embodiments of the disclosure are described in detail below. While specific implementations are described, it should be understood that this is done for illustration purposes only. Other components and configurations may be used without parting from the spirit and scope of the disclosure, and characteristics/configurations of the exemplary implementations provided are not exclusive to the implementation in which they are presented.

A system, method and computer-readable storage devices are disclosed which provide a mechanism to perform two functions required for high speed LWD (Logging While Drilling) and/or MWD (Measurement While Drilling) operations in a single step: frequency channel mapping (to determine preferred operating frequencies) and equalizer initialization (to rapidly converge an equalizer so that mud channel distortion is removed quickly). This saves time at start up, and generates a high fidelity map of channel characteristics so that optimal operating parameters, including operating center frequency, can be determined. Both functions are performed with a single sounder signal without performance compromises to either one. In other words, rather than performing two distinct operations requiring downhole communications, a single sounder signal provides the needed data to sound a communication path (such as a mud column or solid members of a drill string) and initialize the equalizer. Making this possible is the use of a frequency hopped sounding signal, where the signal being communicated jumps from mini-frequency band to mini-frequency band within the frequency range being tested and in a non-contiguous pattern.

Although this can be employed with respect to LWD, it can be suitably employed with any communication downhole and to and from the surface, and for communications between downhole locations. For example, the principles disclosed herein can apply to wireline communications, mud column communications (i.e., mud pulse telemetry), structural members, or other signal transmissions where the waveform travels from downhole to surface, surface to downhole, or between communication points of the pipe, and encounters attenuation and distortion. For example, if communicating via wireline communications, the system can utilize wires, the drill itself, or other conductive mechanisms for communicating. If the system is communicating via mud pulse telemetry, transducers will generate pressure pulses (positive/negative pulse systems) or a carrier frequency (continuous wave pulse system) within the mud column. The pathways these various communications can take are referred to as a communication path.

As an example, a system configured according to this disclosure identifies a frequency range for sounding a mud column between a first device at a first location within a wellbore and a second device at a second location of the wellbore. Center frequencies, bandwidths, and timeframes are assigned to each of a plurality of sounding sequences, such that an entirety of the frequency range is assigned to the plurality of sounding sequences, and wherein when played in order according to the timeframe assigned to each sounding sequence in the plurality of sounding sequences, a sounding signal having a non-contiguous frequency is produced. The system receives an attenuated sounding signal, the attenuated sounding signal having been generated as the sounding signal by another device and attenuated by the mud column. The system compares the attenuated sounding signal to the sounding signal, to yield a comparison, and estimates a transfer function of the mud column based on the comparison. The system also initializes an equalizer based on the comparison.

A system configured per this disclosure performs channel mapping functions and equalizer initialization functions more rapidly than would be possible than if separate wideband frequency mapping and narrowband equalizer initialization sequences were required. The channel mapping function helps identify a preferred frequency band for operation to improve data transmission rates, and rapid convergence of the equalizer function will help improve fidelity of signal reception in distorted channels. A single channel sounder signal can be used to perform both functions, and combining both functions in a single signal can decrease the required time to start of the actual data transmission sequence. In addition, the non-contiguous nature of the channel sounder signal allows non-contiguous frequencies to be sounded, meaning that rather than sounding all frequencies between upper and lower frequency limits, the channel sounder signal can only sweep the frequencies a user has interest in.

Additional details and examples will be provided below. The disclosure now turns to a description of the Figures provided.

As shown in FIG. 1, the drill string 32 supports several components along its length. A sensor sub-unit 52 is shown for detecting conditions near the drill bit 50, conditions which can include such properties as formation fluid density, temperature and pressure, and azimuthal orientation of the drill bit 50 or string 32. The drill bit 50 can be rotated via rotating the drill string, and/or a downhole motor near the drill bit 50. During drilling, measurement while drilling (MWD)/logging while drilling (LWD) procedures can be conducted. The frequency hopped sounding signal as disclosed herein can be suitably employed for the communication operations of MWD and LWD. The sensor sub-unit 52 can detect characteristics of the formation surrounding the wellbore 48 proximate the sensor sub-unit 52 such as resistivity and porosity. Other sensor sub-units 35, 36 are shown within the cased portion of the well which can be similarly enabled to sense nearby characteristics and conditions of the drill string, formation fluid, casing and surrounding formation. Regardless of which conditions or characteristics are sensed, data indicative of those conditions and characteristics is either recorded downhole, for instance at the processor 44 for later download, or communicated to the surface either by mud pulse telemetry, wire, wirelessly or otherwise, and can suitably employ the frequency hopped sounding signal as disclosed herein.

As noted one mode of communication which may employ a frequency hopped sounding signal disclosed herein includes mud pulse telemetry. This may involve the use of drilling mud 40 that is pumped via conduit 42 to a downhole mud motor 46 and/or through nozzles in the drill bit 50. The drilling mud is circulated down through the drill string 32 and up the annulus 33 around the drill string 32 to cool the drill bit 50 and remove cuttings from the wellbore 48. For purposes of communication, resistance to the incoming flow of mud can be modulated downhole to send backpressure pulses up to the surface for detection at sensor 24, and from which representative data is sent along communication channel 20 (wired or wirelessly) to one or more processors 18, 12 for recordation and/or processing.

Other communication modes can include wireless transmission. If wirelessly, the downhole transceiver (antenna) 38 can be utilized to send data to a local processor 18, via topside transceiver (antenna) 14. There the data may be either processed or further transmitted along to a remote processor 12 via wire 16 or wirelessly via antennae 14 and 10.

Alternatively, the communication can occur via the drill string 32 (wireline communications), then further communicated along communication channel 20. Again, the frequency hopped sounding signal as disclosed herein can be employed for such communications.

The sensor sub-unit 52 is located along the drill string 32 above the drill bit 50. The sensor sub-unit 52 can carry a signal processing apparatus 53 for transmitting, receiving, and processing signals passing along drill string 32 to and from the surface 27. For illustrative purposes, the sensor sub-unit 36 is shown in FIG. 1 positioned above the mud motor 46 that may rotate the drill bit 50. Additional sensor sub-units 35, 36 can be included as desired in the drill string 32. The sensor sub-unit 52 positioned below the motor 46 has apparatus 53 to communicate with the sensor sub-unit 36 in order to relay information to the surface 27. Communication between the apparatus 53 below the motor 113 and the downhole apparatus 37 of the sensor sub-unit 36 can be accomplished by any of the communication modes discussed hereinabove.

At the surface 27, supported by the drill string 32, a surface sensor sub-unit 35 carries apparatus 39. The surface sensor sub-unit 35 can be supported also by the surface rig 26. Signals received at the apparatus 39 may be processed within the apparatus 39 or sent to a surface installation 19 via a communication path 22 for processing.

As shown in FIG. 1, the surface installation 19 includes a transceiver (antennae) 14 that can communicate with the surface sensor sub-unit 35, the personal computer 18 coupled to the transceiver 14 for processing the signals from the sensor sub-units 35, 36, 52, and a real-time clock 17 for time-stamping signals and sensor data from the sensor sub-units.

Power for the sensor sub-units and communication apparatuses in the sub-units may be provided by batteries housed therein. Alternatively, power may be generated from the flow of drilling mud through the drill string using turbines as is known in the art.

The use of coiled tubing 28 and wireline 30 can be deployed as an independent service upon removal of the drill string 32 to dispose tools downhole. Communication via the deployed wireline can also suitably employ the frequency hopped sounder signal disclosed herein.

Figure 2:
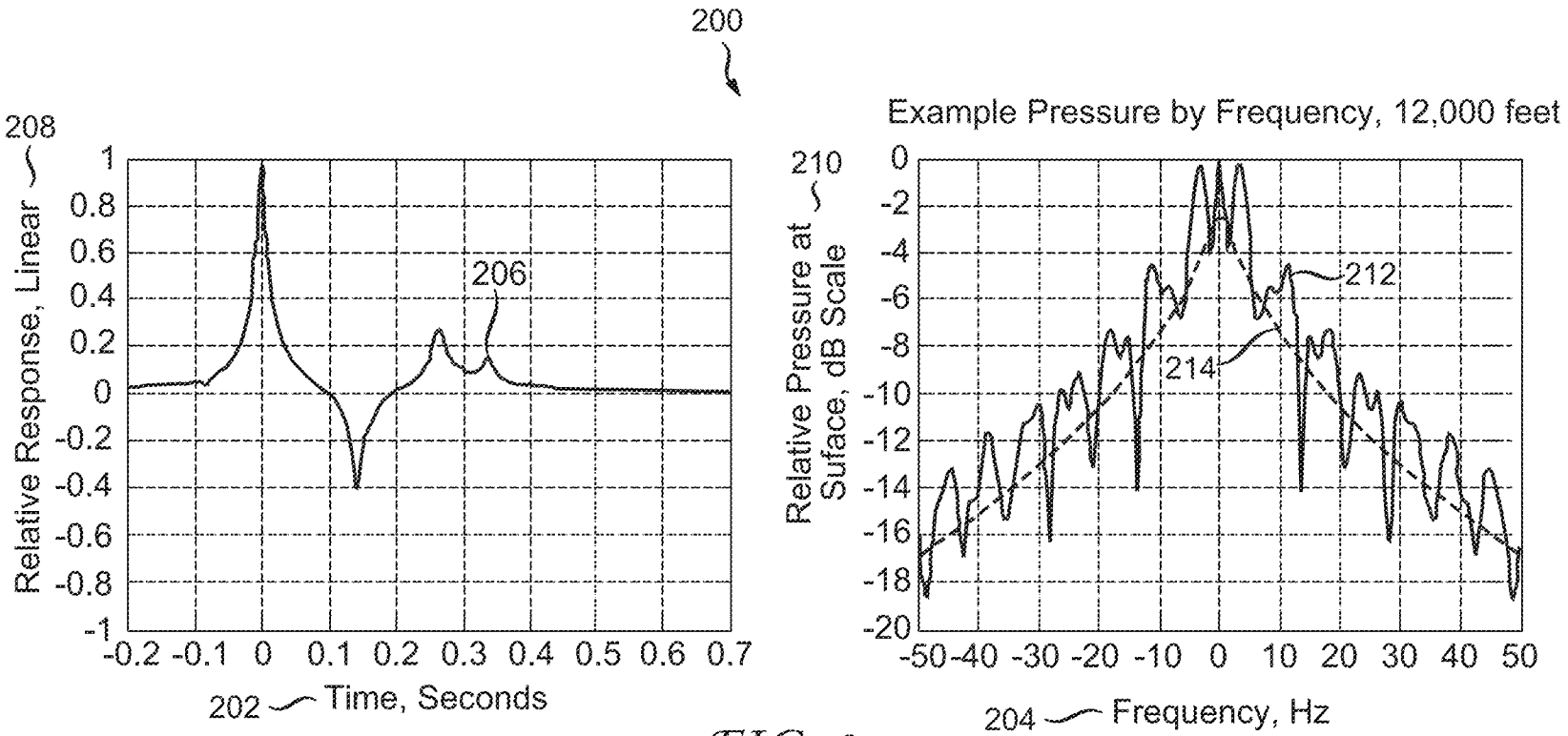
FIG. 2 illustrates a time response and a frequency response of a mud column.

FIG. 2 illustrates 200 a time response 206 and a frequency response 212 of a mud column. The left hand side (the time response) shows a time response of the echoes in a channel, measured based on linear relative response 208. The echoes themselves are shown by the peaks in the transfer function 206. The smoothing effect of the peaks over time 202 is caused by frequency dependent attenuation in the channel.

The right hand side of the FIG. 200 shows the frequency response 212, as measured in relative attenuation over frequency 210, for the same channel. The frequency dependent attenuation is highlighted by the dashed line 214. The nulls (the low points of the frequency response 212) are caused by the echoes and are added to form the frequency response 212. The goal of a channel mapping function is to determine the attenuation at each frequency in order to identify acceptable operating frequencies for the MPT (Mud Pulse Telemetry) communication signal. The goal of the equalizer initialization function is to accelerate the convergence of the equalizer to correct for the distortion caused by the frequency domain nulls of the channel. The frequency response 212 is an example of a frequency map, illustrating frequency bands and/or ranges which have higher attenuation than other frequency bands and/or ranges.

Figure 3:
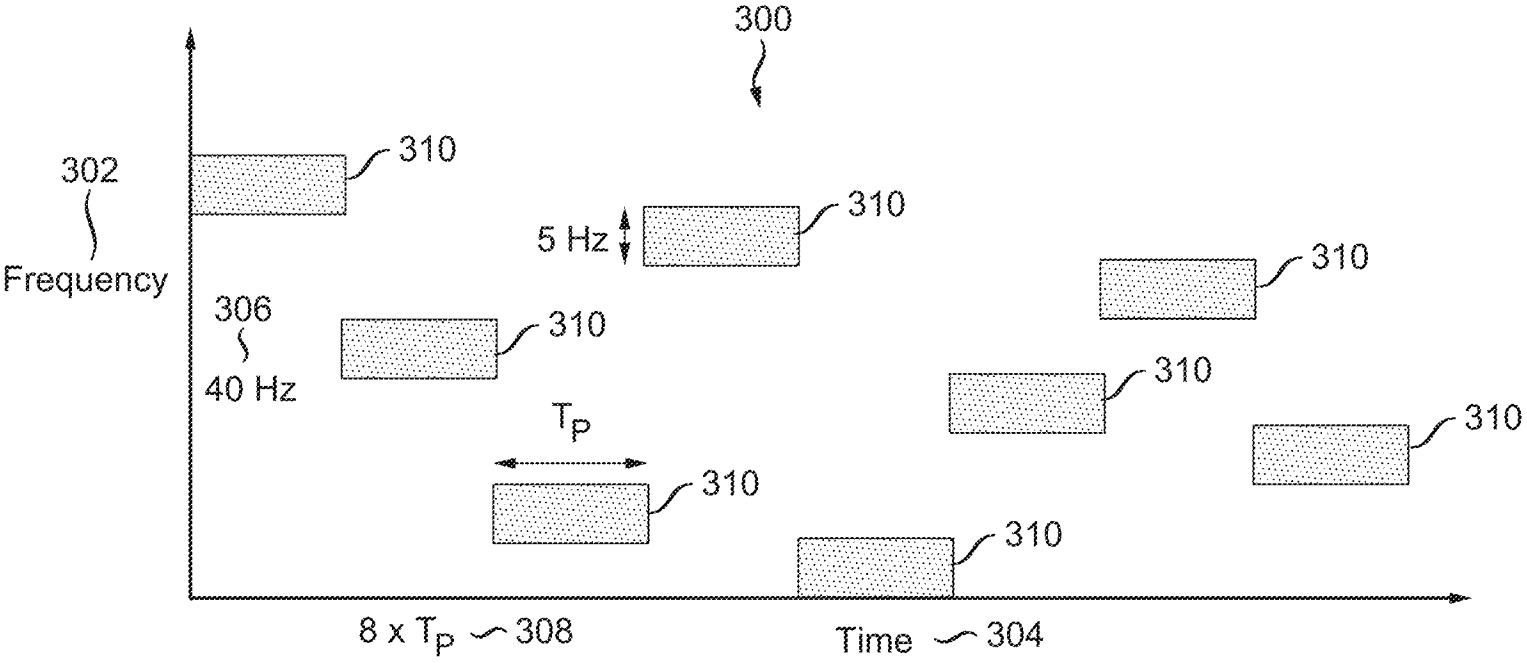
FIG. 3 illustrates a frequency hopped sounder signal to support both channel mapping and equalization initialization.

FIG. 3 illustrates a frequency hopped sounder signal 300 to support both channel mapping and equalization initialization. A series of modulated signals 310, each at a narrow bandwidth (e.g., 5 Hz in this case) are transmitted across a frequency range of interest (e.g., 40 Hz 306 in this case) in a non-stepped manner.

Consider the following example. A drilling operation desires to perform channel mapping and equalizer initialization using a sounding signal. A frequency range of 40 Hz is selected for the sounding signal, with the sounding signal being made of eight smaller bandwidth signals 310. The number of smaller bandwidth signals 310 can vary as needed by specific configurations. Each of the smaller bandwidth signals 310 has a center frequency assigned, a bandwidth, and a timeframe. The bandwidth of each of these smaller signals 310 can be constant (for example, all eight smaller bandwidth signals could have a bandwidth of 5 Hz), or can vary between the smaller signals as required. The bandwidths assigned to each of the smaller bandwidth signals 310 can overlap with that of other small bandwidth signals being generated, or can be configured not to overlap other assigned bandwidths. Some configurations can have a "quiet" space between frequency ranges of the smaller bandwidth signals 310, where frequencies are not assigned to be sounded. Thus the series of steps 310 can provide even coverage across the frequency range 302, 306, or can cover some frequencies more than others. For example, in some scenarios overlap can occur of various frequencies. Also the lowest frequency of the smaller bandwidth signals 310 may not include 0 Hz, but instead the lower frequency limit of the lowest small band 310 can be 10 Hz, 15 Hz, or any other frequency as required by specific instances. The use of narrow bandwidth individual signals provides a flat overall response, with abrupt roll-off at the band edges. This is an attractive feature, and can provide the ability to measure the channel evenly from baseband through the highest frequency of interest.

The center frequencies are selected in a deterministic (non-pseudorandom) fashion. The timeframes selected and/or assigned to each step 310 can have a constant duration $T_P$, or can vary between steps 310 as required. The total time 304 of the frequency hopped sounder signal 300 will be the sum of the assigned timeframes. If the timeframes are constant, the total time 304 will be the product 308 of the number of smaller signals 310 by the constant duration $T_P$. Determinations of duration can be made to more completely flatten the spectrum in certain areas, focus energy in areas where more mapping is required, and/or dedicate some sequences to more dedicated equalizer initialization.

As illustrated, when the frequency hopped sounder signal 300 is generated, each individual small bandwidth signal 310 will be generated in the assigned timeframes, resulting in a frequency hopped sounder signal 300 which is continuous in time but non-contiguous in frequency, hopping between the assigned bands. Thus the entirety of the frequency range (in this example, 40 Hz) is sounded using the frequency hopped sounder signal. As will be described further below, each of the individual small bandwidth signals 310 can be modulated, and the frequency hopped sounder signal 300 can be upconverted (frequency shifted) from baseband to a desired frequency range as needed. For example, each of the individual small bandwidth signals 310 can be modulated and transmitted as the frequency hopped sounder signal 300. Upconversion, if desired, can occur digitally or via analog.

Figure 4:
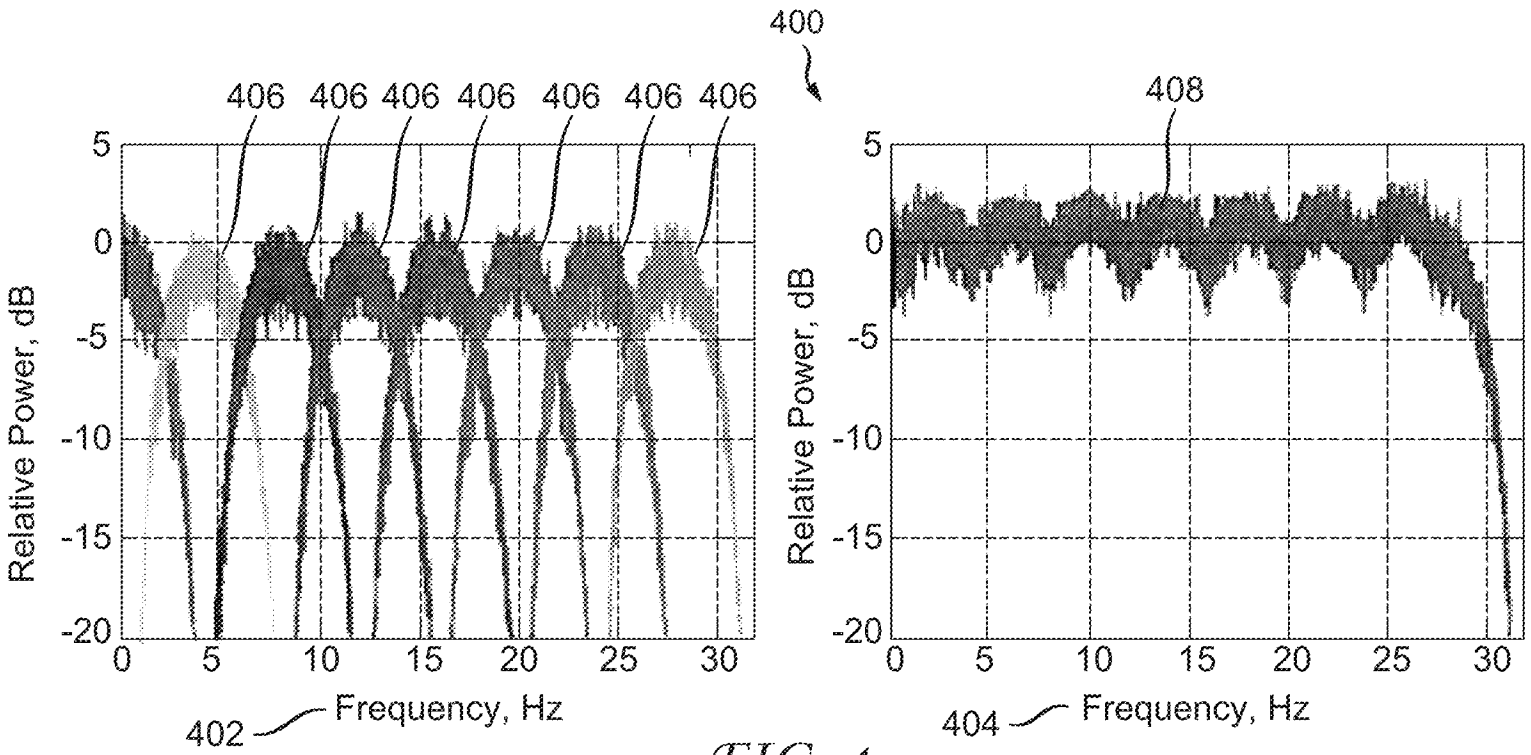
FIG. 4 illustrates a frequency response from a frequency hopping sequence.

FIG. 4 illustrates a frequency response 400 from a frequency hopping sequence, specifically the frequency hopped sounder signal illustrated in FIG. 3. The left hand portion of the figure shows the individual spectra 406 of each sequence 310, with each individual spectra 406 having a distinct frequency 402 range. BPSK modulation is used in this particular example, although any type of passband modulation can be used, including QPSK, PSK, CPM, SOQPSK, MSK, variants of any of these modulation schemes, and others. The right hand portion of the figure shows the combined results 408 if the results 406 of each signal 310 are added together. The combined result 408 is, in this case, a relatively even (flat) sounder signal spectrum that goes from baseband through a high frequency of interest (in this case, 28 Hz).

Figure 5:
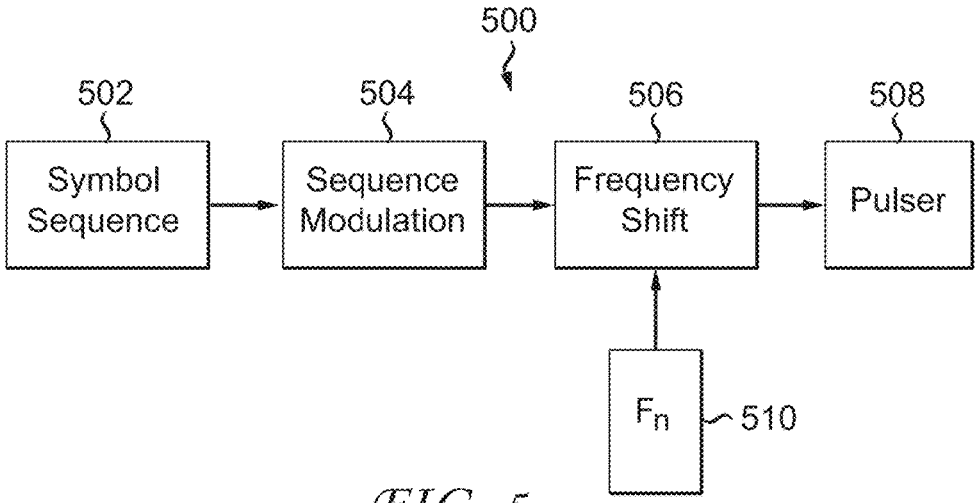
FIG. 5 illustrates an exemplary implementation of a frequency hopping transmission.

FIG. 5 illustrates an exemplary implementation 500 of a frequency hopping transmission. The implementation 500 illustrated provides an overview of one method to generate the frequency hopped signal. Other methods are also possible to generate the frequency hopped signal, and are within the scope of this disclosure. For example, signal processing can also be performed at "passband." This particular implementation 500 involves the generation of a symbol sequence 502, the modulation of the sequence 504 using one or more modulation schemes (such as BPSQ, QPSK, 8PSK (8 Phase Shift Keying), PSK, CPM, SOQPSK, MSK, etc), and the shifting of the desired sequence to a particular frequency 506 that corresponds to the frequency prescribed in the hopping sequence ($F_n$ 510 represents the frequency of each step in the frequency hopping signal, indexed as n). The resulting signal is passed to a pulser 508 so that the signal can be translated to pressure shifts in the mud column, to be transmitted either from downhole to the surface, or from the surface to downhole.

The symbol sequence 502 generated and used in each segment of the frequency hopping process can be the same, or the symbol sequence can vary each for each step (as indexed by n). The modulation technique 504 employed can be similarly consistent between indices (n), or it can vary each for each step/hop. The collection of $F_n$ values can form a coverage of the channel desired for channel mapping, and one or more $F_n$ values can provide the opportunity to initialize an equalizer prior to modulation of data following receiving of the sounder signal.

Figure 6:
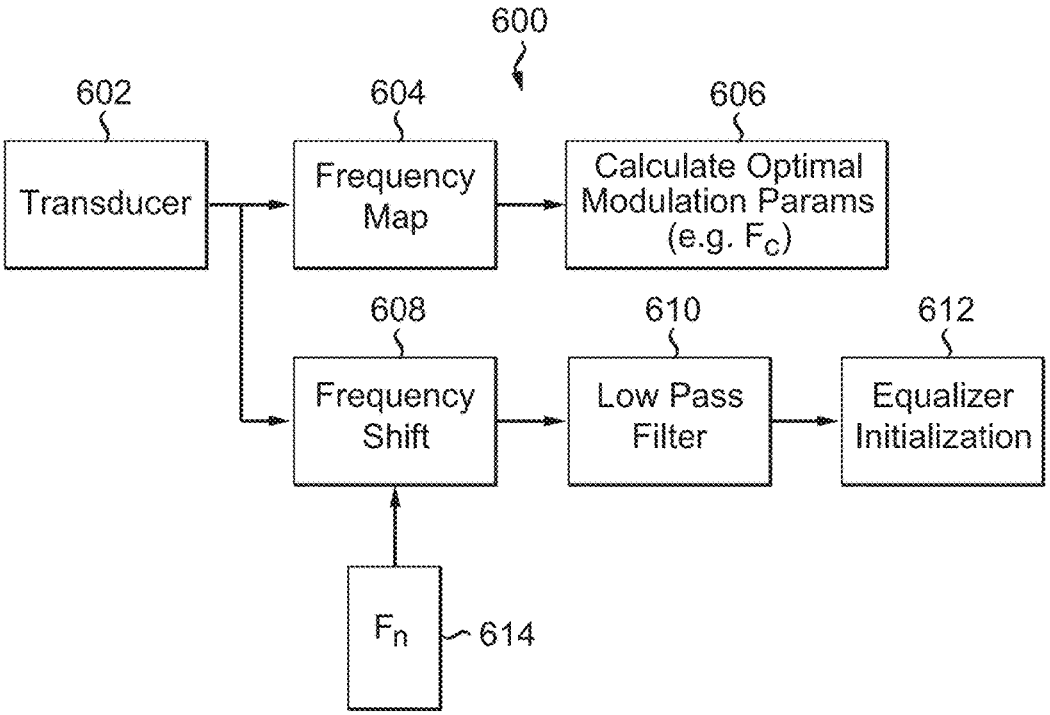
FIG. 6 illustrates an exemplary implementation of receiving and processing a frequency hopped sounder signal.

FIG. 6 illustrates an exemplary implementation 600 of receiving and processing a frequency hopped sounder signal. The illustrated implementation 600 is one of several methods available to conduct channel mapping and equalization initialization. Other methods and variations of this implementation 600 are possible within the scope of this disclosure. A transducer 602 measures the pressure shifts from the mud channel. The upper path of the illustrated implementation 600 shows using the measured pressure shifts to generate a frequency map 604 and calculate optimal modulation parameters 606, such as center frequency $F_C$, modulation schemes, bandwidth, etc., for transmission of data through the mud column. First, a frequency mapping function is performed which involves the estimation of the spectrum of the received signal. The received signal is compared to the known transmitted signal, based on the comparison the attenuation of the mud column is calculated.

When the attenuation effects by frequency are combined with the noise density by frequency, a link margin can be calculated for each frequency. This link margin becomes the frequency map 604.

From this link margin frequency map, optimal modulation parameters can be calculated 606. The link margin map itself can be used to determine the type of signal to be used (e.g. QPSK or BPSK), preferred center frequencies and bandwidths to use for future communications. A larger link margin allows for higher order constellations and for wider bandwidths. Additionally, the location of the largest margin can be used to determine center frequencies that are best for MPT data transmissions. For example, the "optimal" modulation pattern can be determined based on the modulation pattern which results in the least attenuation. Likewise, other modulation parameters (such as bandwidths, frequency overlap, frequency gaps, center frequencies, timeframes of individual hopper frequencies) can be selected because the portions of the link margin associated with those modulation parameters have less attenuation than other portions.

The lower portion of the figure shows the path through which equalizer initialization 612 can be conducted. One or more paths can be added, each one using a segment of frequency to initialize an equalizer. The center frequency of interest can be used to translate the desired signal to baseband though a frequency shift 608. For example, the derived signal from the transducer 602 can be downconverted to a baseband signal. A low pass filter 610 can then applied the baseband signal to isolate the desired frequency segment from others. The resulting signal can then be fed to an equalizer initialization algorithm 612. This can be a time domain, frequency domain, matrix based, gradient based, or other type of equalizer initialization algorithm 612. The proposed frequency hopping sequence is independent of the particular equalizer initialization 612 approach to be used.

Figure 7:
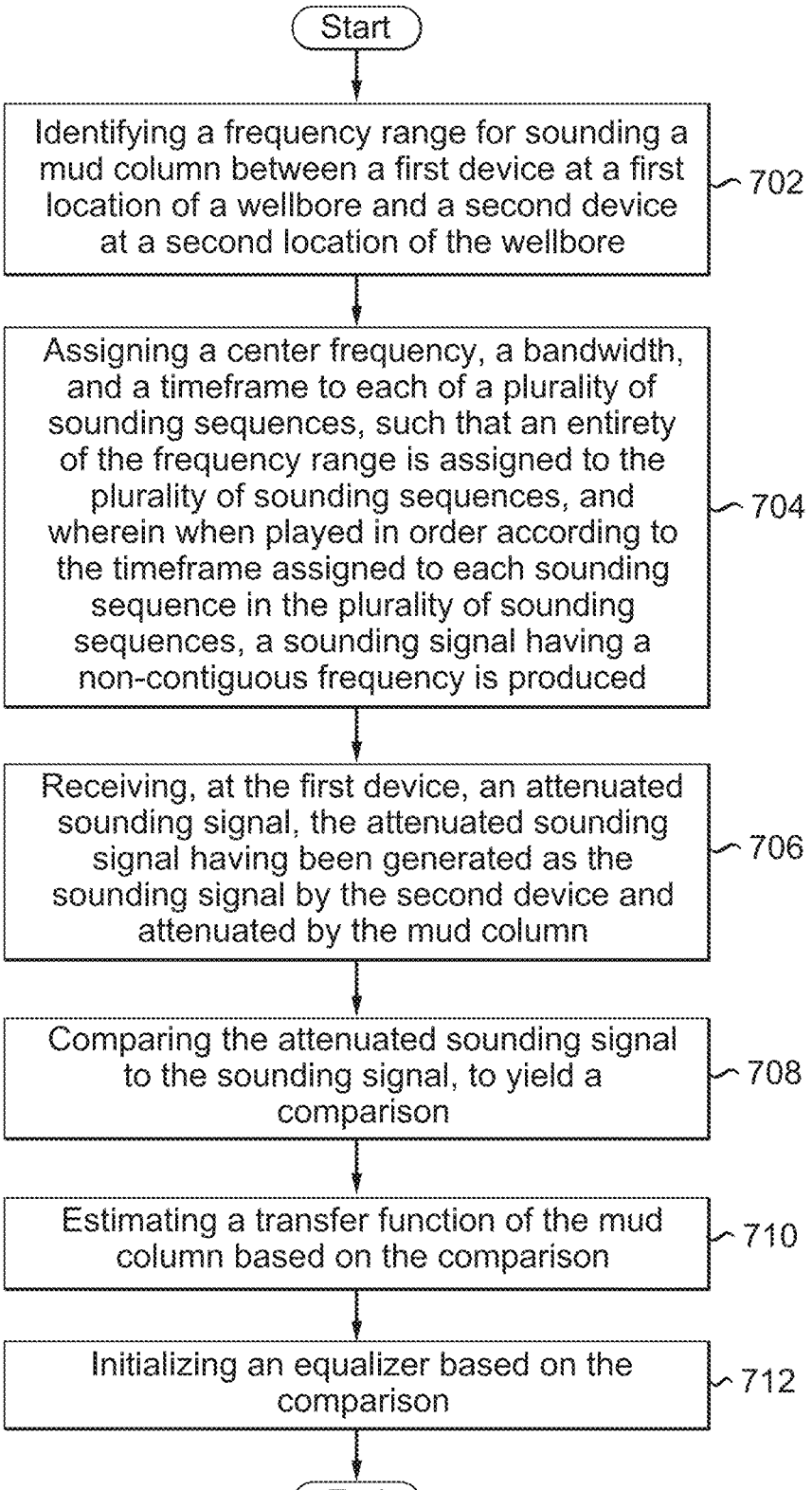
FIG. 7 illustrates an example method embodiment.
Figure 8:
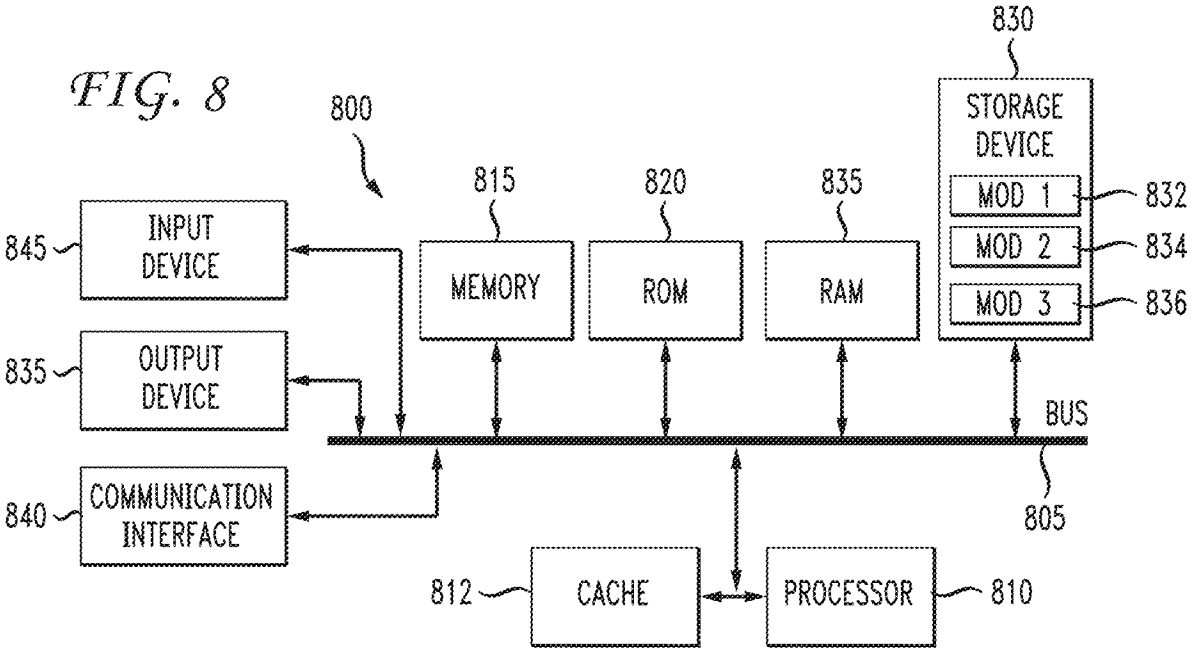
FIG. 8 illustrates an exemplary system embodiment.

FIG. 7 illustrates an example method embodiment. For the sake of clarity, the method is described in terms of an exemplary system 800 as shown in FIG. 8 configured to practice the method. The steps outlined herein are exemplary and can be implemented in any combination thereof, including combinations that exclude, add, or modify certain steps.

The system 800 identifies a frequency range for sounding a mud column between a first device at a first location within a wellbore and a second device at a second location of the wellbore (702). The first location can be at the surface of the wellbore and the second location at a downhole location of the wellbore, or vice versa. The system 800 assigns a center frequency, a bandwidth, and a timeframe to each of a plurality of sounding sequences, such that an entirety of the frequency range of interest is assigned to the plurality of sounding sequences, and wherein when played in order according to the timeframe assigned to each sounding sequence in the plurality of sounding sequences, a sounding signal having a non-contiguous frequency is produced (704).

An attenuated sounding signal is received at the first device, the attenuated sounding signal having been generated as the sounding signal by the second device and attenuated by the mud column (706). In certain configurations, the first device can be a sensor and the second device can be a pulser, whereas in other configurations the first device can be the pulser and the second device can be the sensor. In addition, in certain configurations the received signal can be frequency shifted (i.e., upconverted or downconverted) to baseband, to a frequency range of interest (such as a passband). The system 800 compares the attenuated sounding signal to the sounding signal, to yield a comparison (708), and estimates a transfer function of the mud column based on the comparison (710). Using this transfer function, the system 800 can identify frequencies, bandwidths, modulation schemes, and other modulation parameters for use in further downhole communications. For example, the system can generate a link margin frequency map using the comparison, determine a communication channel bandwidth based on the link margin frequency map, and select the modulation parameters for a communication channel based on the link margin frequency map. Exemplary modulation schemes can include BPSK, QPSK, 8PSK, PSK, CPM, SOQPSK, and MSK, as well as any other modulation scheme known to those of skill in the art.

The system also initializes an equalizer based on the comparison (712). In this manner, the system 800 uses frequency hopped deterministic (non-pseudorandom) signal sequences in a manner that allows it to perform channel mapping functions, equalizer initialization functions, or both. The described functionality can occur during drilling operations, or when drilling is not occurring.

In certain configurations, there can be advantages to utilizing a sounding signal in which the frequencies tested are contiguous and/or pseudo-randomly assigned. In such instances, the (non-hopped and/or random) sounding signal used to identify the transfer function can also be used to initialize the equalizer in accordance with the principles described herein.

A brief description of a basic general purpose system or computing device in FIG. 8 which can be employed to practice the concepts, methods, and techniques disclosed above is illustrated. With reference to FIG. 8, an exemplary system and/or computing device 800 includes a processing unit (CPU or processor) 810 and a system bus 805 that couples various system components including the system memory 815 such as read only memory (ROM) 820 and random access memory (RAM) 835 to the processor 810. The processors of FIG. 1 (i.e., the downhole processor 44, the local processor 18, and the remote processor 12, can all be forms of this processor 810. The system 800 can include a cache 812 of high-speed memory connected directly with, in close proximity to, or integrated as part of the processor 810. The system 800 copies data from the memory 815 and/or the storage device 830 to the cache 812 for quick access by the processor 810. In this way, the cache provides a performance boost that avoids processor 810 delays while waiting for data. These and other modules can control or be configured to control the processor 810 to perform various operations or actions. Other system memory 815 may be available for use as well. The memory 815 can include multiple different types of memory with different performance characteristics. It can be appreciated that the disclosure may operate on a computing device 800 with more than one processor 810 or on a group or cluster of computing devices networked together to provide greater processing capability. The processor 810 can include any general purpose processor and a hardware module or software module, such as module 1 832, module 2 834, and module 3 836 stored in storage device 830, configured to control the processor 810 as well as a special-purpose processor where software instructions are incorporated into the processor. The processor 810 may be a self-contained computing system, containing multiple cores or processors, a bus, memory controller, cache, etc. A multi-core processor may be symmetric or asymmetric. The processor 810 can include multiple processors, such as a system having multiple, physically separate processors in different sockets, or a system having multiple processor cores on a single physical chip. Similarly, the processor 810 can include multiple distributed processors located in multiple separate computing devices, but working together such as via a communications network. Multiple processors or processor cores can share resources such as memory 815 or the cache 812, or can operate using independent resources. The processor 810 can include one or more of a state machine, an application specific integrated circuit (ASIC), or a programmable gate array (PGA) including a field PGA.

The system bus 805 may be any of several types of bus structures including a memory bus or memory controller, a peripheral bus, and a local bus using any of a variety of bus architectures. A basic input/output (BIOS) stored in ROM 820 or the like, may provide the basic routine that helps to transfer information between elements within the computing device 800, such as during start-up. The computing device 800 further includes storage devices 830 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. The storage device 830 can include software modules 832, 834, 836 for controlling the processor 810. The system 800 can include other hardware or software modules. The storage device 830 is connected to the system bus 805 by a drive interface. The drives and the associated computer-readable storage devices provide nonvolatile storage of computer-readable instructions, data structures, program modules and other data for the computing device 800. In one aspect, a hardware module that performs a particular function includes the software component stored in a tangible computer-readable storage device in connection with the necessary hardware components, such as the processor 810, bus 805, display 170, and so forth, to carry out a particular function. In another aspect, the system can use a processor and computer-readable storage device to store instructions which, when executed by the processor, cause the processor to perform operations, a method or other specific actions. The basic components and appropriate variations can be modified depending on the type of device, such as whether the device 800 is a small, handheld computing device, a desktop computer, or a computer server. When the processor 810 executes instructions to perform "operations", the processor 810 can perform the operations directly and/or facilitate, direct, or cooperate with another device or component to perform the operations.

Although the exemplary embodiment(s) described herein employs the hard disk 830, other types of computer-readable storage devices which can store data that are accessible by a computer, such as magnetic cassettes, flash memory cards, digital versatile disks (DVDs), cartridges, random access memories (RAMs) 835, read only memory (ROM) 820, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with the computing device 800, an input device 190 represents any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art. In some instances, multimodal systems enable a user to provide multiple types of input to communicate with the computing device 800. The communications interface 840 generally governs and manages the user input and system output. There is no restriction on operating on any particular hardware arrangement and therefore the basic hardware depicted may easily be substituted for improved hardware or firmware arrangements as they are developed.

For clarity of explanation, the illustrative system embodiment is presented as including individual functional blocks including functional blocks labeled as a "processor" or processor 810. The functions these blocks represent may be provided through the use of either shared or dedicated hardware, including, but not limited to, hardware capable of executing software and hardware, such as a processor 810, that is purpose-built to operate as an equivalent to software executing on a general purpose processor. For example the functions of one or more processors presented in FIG. 8 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 820 for storing software performing the operations described below, and random access memory (RAM) 835 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 800 shown in FIG. 8 can practice all or part of the recited methods, can be a part of the recited systems, and/or can operate according to instructions in the recited tangible computer-readable storage devices. Such logical operations can be implemented as modules configured to control the processor 810 to perform particular functions according to the programming of the module. For example, FIG. 8 illustrates three modules Mod1 832, Mod2 834 and Mod3 836 which are modules configured to control the processor 810. These modules may be stored on the storage device 830 and loaded into RAM 835 or memory 815 at runtime or may be stored in other computer-readable memory locations.

One or more parts of the example computing device 800, up to and including the entire computing device 800, can be virtualized. For example, a virtual processor can be a software object that executes according to a particular instruction set, even when a physical processor of the same type as the virtual processor is unavailable. A virtualization layer or a virtual "host" can enable virtualized components of one or more different computing devices or device types by translating virtualized operations to actual operations. Ultimately however, virtualized hardware of every type is implemented or executed by some underlying physical hardware. Thus, a virtualization compute layer can operate on top of a physical compute layer. The virtualization compute layer can include one or more of a virtual machine, an overlay network, a hypervisor, virtual switching, and any other virtualization application.

The processor 810 can include all types of processors disclosed herein, including a virtual processor. However, when referring to a virtual processor, the processor 810 includes the software components associated with executing the virtual processor in a virtualization layer and underlying hardware necessary to execute the virtualization layer. The system 800 can include a physical or virtual processor 810 that receive instructions stored in a computer-readable storage device, which cause the processor 810 to perform certain operations. When referring to a virtual processor 810, the system also includes the underlying physical hardware executing the virtual processor 810.

Embodiments within the scope of the present disclosure may also include tangible and/or non-transitory computer-readable storage devices for carrying or having computer-executable instructions or data structures stored thereon. Such tangible computer-readable storage devices can be any available device that can be accessed by a general purpose or special purpose computer, including the functional design of any special purpose processor as described above. By way of example, and not limitation, such tangible computer-readable devices can include RAM, ROM, EEPROM, CD-ROM or other optical disk storage, magnetic disk storage or other magnetic storage devices, or any other device which can be used to carry or store desired program code in the form of computer-executable instructions, data structures, or processor chip design. When information or instructions are provided via a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Claim language reciting "at least one of" a set indicates that one member of the set or multiple members of the set satisfy the claim.

Statements of the disclosure include:

Statement 1: A method comprising: identifying a frequency range for sounding a communication path between a first device at a first location within a wellbore and a second device at a second location within the wellbore; generating a sounding signal having a non-contiguous frequency with the second device by assigning a center frequency, a bandwidth, and a timeframe to each of a plurality of sounding sequences, such that an entirety of the frequency range is assigned to the plurality of sounding sequences, and playing the plurality of sounding sequences in order according to the timeframe assigned to each sounding sequence in the plurality of sounding sequences; transmitting the sounding signal through the communication path to produce an attenuated sounding signal; receiving, at the first device, the attenuated sounding signal; comparing the attenuated sounding signal to the sounding signal, to yield a comparison; and estimating a transfer function of the communication path based on the comparison.

Statement 2: The method of Statement 1, wherein the first device comprises a sensor and the second device comprises a pulser.

Statement 3: The method Statement 1 or Statement 2, wherein the receiving of the attenuated sounding signal occurs during a drilling operation.

Statement 4: The method of any of the preceding Statements, further comprising initializing an equalizer based on the comparison.

Statement 5: The method according to any of the preceding Statements, further comprising: generating a link margin frequency map using the comparison; determining a communication channel bandwidth based on the link margin frequency map; and selecting modulation parameters for a communication channel based on the link margin frequency map.

Statement 6: The method according to any one of the preceding Statements, wherein the modulation parameters comprise a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

Statement 7: The method according to any one of the preceding statements, further comprising shifting the attenuated sounding signal after receiving the attenuated sounding signal.

Statement 8: The method according to any one of the preceding statements, wherein the shifting of the attenuated sounding signal is a frequency down-conversion.

Statement 9: The method according to any one of the preceding statements, wherein the first location is approximately at a surface location of the wellbore and the second location is at a downhole location of the wellbore.

Statement 10: The method according to any one of the preceding statements, wherein the second location is approximately at a surface location of the wellbore and the first location is at a downhole location of the wellbore.

Statement 11: A system comprising: a processor; and a computer-readable storage medium having instructions stored which, when executed by the processor, cause the processor to perform operations comprising: identifying a frequency range for sounding a communication path between a first device at a first location within a wellbore and a second device at a second location within the wellbore; generating a sounding signal having a non-contiguous frequency with the second device by assigning a center frequency, a bandwidth, and a timeframe to each of a plurality of sounding sequences, such that an entirety of the frequency range is assigned to the plurality of sounding sequences, and playing the plurality of sounding sequences in order according to the timeframe assigned to each sounding sequence in the plurality of sounding sequences; transmitting the sounding signal through the communication path to produce an attenuated sounding signal; receiving, at the first device, the attenuated sounding signal; comparing the attenuated sounding signal to the sounding signal, to yield a comparison; and estimating a transfer function of the communication path based on the comparison.

Statement 12: The system of Statement 11, wherein the first device comprises a sensor and the second device comprises a pulser.

Statement 13: The system according to any one of Statements 11 to 12, wherein the receiving of the attenuated sounding signal occurs during a drilling operation.

Statement 14: The system according to any one of Statements 11 to 13, the computer-readable storage medium having additional instructions stored which, when executed by the processor, cause the processor to perform operations comprising initializing an equalizer based on the comparison.

Statement 15: The system according to any one of Statements 11 to 14, the computer-readable storage medium having additional instructions stored which, when executed by the processor, cause the processor to perform operations comprising: generating a link margin frequency map using the comparison; determining a communication channel bandwidth based on the link margin frequency map; and selecting modulation parameters for a communication channel based on the link margin frequency map.

Statement 16: The system according to any one of Statements 11 to 15, wherein the modulation parameters comprise a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

Statement 17: The system according to any one of Statements 11 to 16, the computer-readable storage medium having additional instructions stored which, when executed by the processor, cause the processor to perform operations comprising shifting the attenuated sounding signal after receiving the attenuated sounding signal.

Statement 18: The system according to any one of Statements 11 to 17, wherein the shifting of the attenuated sounding signal is a frequency down-conversion.

Statement 19: The system according to any one of Statements 11 to 18, wherein the first location is approximately at a surface location of the wellbore and the second location is at a downhole location of the wellbore.

Statement 20: The system according to any one of Statements 11 to 19, wherein the second location is approximately at a surface location of the wellbore and the first location is at a downhole location of the wellbore.

Statement 21: A computer-readable storage device having instructions stored which, when executed by a computing device, cause the computing device to perform operations comprising: identifying a frequency range for sounding a communication path between a first device at a first location within a wellbore and a second device at a second location within the wellbore; generating a sounding signal having a non-contiguous frequency with the second device by assigning a center frequency, a bandwidth, and a timeframe to each of a plurality of sounding sequences, such that an entirety of the frequency range is assigned to the plurality of sounding sequences, and playing the plurality of sounding sequences in order according to the timeframe assigned to each sounding sequence in the plurality of sounding sequences; transmitting the sounding signal through the communication path to produce an attenuated sounding signal; receiving, at the first device, the attenuated sounding signal; comparing the attenuated sounding signal to the sounding signal, to yield a comparison; and estimating a transfer function of the communication path based on the comparison.

Statement 22: The computer-readable storage device of Statement 21, wherein the first device comprises a sensor and the second device comprises a pulser.

Statement 23: The computer-readable storage device according to any one of Statements 21 to 22, wherein the receiving of the attenuated sounding signal occurs during a drilling operation.

Statement 24: The computer-readable storage device according to any one of Statements 21 to 23, having additional instructions stored which, when executed by the computing device, cause the computing device to perform operations comprising initializing an equalizer based on the comparison.

Statement 25: The computer-readable storage device according to any one of Statements 21 to 24, having additional instructions stored which, when executed by the computing device, cause the computing device to perform operations comprising: generating a link margin frequency map using the comparison; determining a communication channel bandwidth based on the link margin frequency map; and selecting modulation parameters for a communication channel based on the link margin frequency map.

Statement 26: The computer-readable storage device according to any one of Statements 21 to 25, wherein the modulation parameters comprise a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

Statement 27: The computer-readable storage device according to any one of Statements 21 to 26, having additional instructions stored which, when executed by the computing device, cause the computing device to perform operations comprising shifting the attenuated sounding signal after receiving the attenuated sounding signal.

Statement 28: The computer-readable storage device according to any one of Statements 21 to 27, wherein the shifting of the attenuated sounding signal is a frequency down-conversion.

Statement 29: The method according to any one of Statements 21 to 28, wherein the first location is approximately at a surface location of the wellbore and the second location is at a downhole location of the wellbore.

Statement 30: The computer-readable storage device according to any one of Statements 21 to 29, wherein the second location is approximately at a surface location of the wellbore and the first location is at a downhole location of the wellbore.

Statement 31: A method comprising: identifying a frequency range for sounding a communication path between a first device at a first location within a wellbore and a second device at a second location of the wellbore; assigning a center frequency, a bandwidth, and a timeframe to each symbol in a symbol sequence, such that an entirety of the frequency range is assigned to the symbol sequence, and wherein when played in order according to the timeframe assigned to each symbol, a sounding signal having a non-contiguous frequency within the frequency range is produced; modulating the symbol sequence, to yield a modulated signal; performing a frequency shift on the modulated signal, to yield a frequency shifted modulated signal; and transmitting the frequency shifted modulated signal from the first device to the second device.

Statement 32: The method of Statement 31, wherein the first device comprises a sensor and the second device comprises a pulser.

Statement 33: The method of Statement 31, wherein the first device comprises a pulser and the second device comprises a sensor.

Statement 34: The method according to any one of Statements 31 to 33, wherein the sensor is located approximately at ground level and the pulser is located at a downhole location.

Statement 35: The method according to any one of Statements 31 to 34, wherein the transmitting of the frequency shifted modulated signal occurs during a drilling operation.

Statement 36: The method according to any one of Statements 31 to 35, wherein the modulation occurs according to a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

Statement 37: The method according to any one of Statements 31 to 36, wherein the frequency shift comprises an upconversion of the modulated signal from a baseband frequency spectrum to a higher frequency spectrum.

Statement 38: The method according to any one of Statements 31 to 37, wherein the frequency shift comprises a downconversion of the modulated signal from a higher frequency spectrum to a lower frequency spectrum.

Statement 39: The method according to any one of Statements 31 to 38, wherein the bandwidth assigned to each symbol at least partially overlaps bandwidth assigned to a distinct symbol in the symbol sequence.

Statement 40: The method according to any one of Statements 31 to 39, wherein center frequency assigned to each symbol is non-pseudorandom.

Statement 41: A method comprising: receiving, at a first device at a first location within a wellbore from a second device at a second location of the wellbore, a modulated signal; generating, based on the modulated signal, a frequency map; identifying, based on the frequency map, a first frequency range and a second frequency range within the modulated signal, wherein the second frequency range has a higher attenuation within the modulated signal; performing a frequency shift on the modulated signal, to yield a frequency shifted modulated signal; filtering the frequency shifted modulated signal; and initializing an equalizer based on the frequency shifted modulated signal.

Statement 42: The method of Statement 41, wherein the first device comprises a sensor and the second device comprises a pulser.

Statement 43: The method of Statement 41, wherein the first device comprises a pulser and the second device comprises a sensor.

Statement 44: The method according to any one of Statements 41-43, the generating of the frequency map and the identifying of the first frequency range and the second frequency range occur in parallel with the performing of the frequency shift, the filtering of the frequency shifted modulated signal, and the initializing of the equalizer.

Statement 45: The method according to any one of Statements 41-43, wherein, the generating of the frequency map and the identifying of the first frequency range and the second frequency range occur in sequentially with the performing of the frequency shift, the filtering of the frequency shifted modulated signal, and the initializing of the equalizer.

Statement 46: The method according to any one of Statements 41-45, further comprising transmitting additional communications using the first frequency range.

Statement 47: The method according to any one of Statements 41-46, wherein the initializing of the equalizer comprises utilizing at least one of a time domain equalizer initialization algorithm, a frequency domain equalizer initialization algorithm, a matrix based equalizer initialization algorithm, and a gradient based equalizer initialization algorithm.

Statement 48: The method according to any one of Statements 41-47, wherein identifying of the first frequency range and the second frequency range within the modulated signal further comprises comparing the modulated signal to a known transmitted signal.

Statement 49: The method according to any one of Statements 41-48, further comprising: measuring pressure shifts of a communication path within the wellbore, wherein the generating of the frequency map is based on the pressure shifts.

Statement 50: The method according to any one of Statements 41-49, wherein the filtering of the frequency shifted modulated signal comprises passing the frequency shifted modulated signal through a low pass filter.

Statement 51: A method comprising: identifying a frequency range for sounding a communication path between a first device at a first location within a wellbore and a second device at a second location of the wellbore; assigning a center frequency, a bandwidth, and a timeframe to each of a plurality of sounding sequences, such that an entirety of the frequency range is assigned to the plurality of sounding sequences, and wherein when played in order according to the timeframe assigned to each sounding sequence in the plurality of sounding sequences, a sounding signal having a non-contiguous frequency is produced; and transmitting the sounding signal from the first device to the second device.

Statement 52: A method comprising: identifying a frequency range for sounding a communication path between a first device at a first location within a wellbore and a second device at a second location of the wellbore; assigning a center frequency, a bandwidth, and a timeframe to each of a plurality of sounding sequences, such that an entirety of the frequency range is assigned to the plurality of sounding sequences, and wherein when played in order according to the timeframe assigned to each sounding sequence in the plurality of sounding sequences, a sounding signal is produced; receiving, at the first device, an attenuated sounding signal, the attenuated sounding signal having been generated as the sounding signal by the second device and attenuated by the communication path; comparing the attenuated sounding signal to the sounding signal, to yield a comparison; estimating a transfer function of the communication path based on the comparison; and initializing an equalizer based on the comparison.

Statement 53: A method comprising: identifying a frequency range for sounding a communication path between a first device at a first location within a wellbore and a second device at a second location of the wellbore; assigning a center frequency, a bandwidth, and a timeframe to each of a plurality of sounding sequences, such that an entirety of the frequency range is assigned to the plurality of sounding sequences, and wherein when played in order according to the timeframe assigned to each sounding sequence in the plurality of sounding sequences, a sounding signal is produced; receiving, at the first device, an attenuated sounding signal, the attenuated sounding signal having been generated as the sounding signal by the second device and attenuated by the communication path; comparing the attenuated sounding signal to the sounding signal, to yield a comparison; and initializing an equalizer based on the comparison.

The various embodiments described above are provided by way of illustration only and should not be construed to limit the scope of the disclosure. For example, the principles herein can be applied to any drilling operation, regardless of the composition of the communication path. Various modifications and changes may be made to the principles described herein without following the example embodiments and applications illustrated and described herein, and without departing from the spirit and scope of the disclosure.

We claim:

1. A method performed by a drilling system in a drilling operation, the method comprising:

identifying, by the drilling system, a frequency range for sounding a communication path between a first device at a first location within a wellbore and a second device at a second location within the wellbore;

generating a sounding signal being continuous in time and non-contiguous in frequency with the second device by:

assigning a center frequency, a bandwidth, and a timeframe to each of a plurality of sounding sequences, such that an entirety of the frequency range is assigned to the plurality of sounding sequences, and wherein the bandwidths assigned to at least two of the plurality of sounding sequences are configured to overlap, and playing the plurality of sounding sequences in order according to the timeframe assigned to each sounding sequence in the plurality of sounding sequences;

transmitting the sounding signal through the communication path to produce an attenuated sounding signal;

receiving, at the first device, the attenuated sounding signal;

comparing, by the drilling system, the attenuated sounding signal to the sounding signal, to yield a comparison, wherein the comparison is used to estimate a transfer function for channel mapping and to initialize an equalizer to reduce distortion effect of frequency selective fading in the drilling operation; and estimating, by the drilling system, the transfer function of the communication path based on the comparison.

2. The method of claim 1, wherein the first device comprises a sensor and the second device comprises a pulser.

3. The method of claim 1, wherein the receiving of the attenuated sounding signal occurs during a drilling operation.

4. The method of claim 1, further comprising initializing by the drilling system, the equalizer based on the comparison.

5. The method of claim 1, further comprising:

generating, by the drilling system, a link margin frequency map using the comparison;

determining, by the drilling system, a communication channel bandwidth based on the link margin frequency map; and selecting, by the drilling system, modulation parameters for a communication channel based on the link margin frequency map.

6. The method of claim 5, wherein the modulation parameters comprise a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

7. The method of claim 1, further comprising shifting, by the drilling system, the attenuated sounding signal after receiving the attenuated sounding signal.

8. The method of claim 7, wherein the shifting of the attenuated sounding signal is a frequency down-conversion.

9. The method of claim 1, wherein the first location is approximately at a surface location of the wellbore and the second location is at a downhole location of the wellbore.

10. The method of claim 1, wherein the second location is approximately at a surface location of the wellbore and the first location is at a downhole location of the wellbore.

11. The method of claim 1 wherein the communication path is a mud column.

12. A drilling system used in a drilling operation, the drilling system comprising:

a processor; and a non-transitory computer-readable storage medium having instructions stored which, when executed by the processor, cause the processor to perform operations comprising:

identifying a frequency range for sounding a communication path between a first device at a first location within a wellbore and a second device at a second location within the wellbore;

generating a sounding signal being continuous in time and non-contiguous in frequency with the second device by:

assigning a center frequency, a bandwidth, and a timeframe to each of a plurality of sounding sequences, such that an entirety of the frequency range is assigned to the plurality of sounding sequences, and wherein the bandwidths assigned to at least two of the plurality of sounding sequences are configured to overlap, and playing the plurality of sounding sequences in order according to the timeframe assigned to each sounding sequence in the plurality of sounding sequences;

transmitting the sounding signal through the communication path to produce an attenuated sounding signal;

receiving, at the first device, the attenuated sounding signal; comparing the attenuated sounding signal to the sounding signal, to yield a comparison, wherein the comparison is used to estimate a transfer function for channel mapping and to initialize an equalizer to reduce distortion effect of frequency selective fading in the drilling operation; and estimating the transfer function of the communication path based on the comparison.

13. The system of claim 12, wherein the first device comprises a sensor and the second device comprises a pulser.

14. The system of claim 12, wherein the receiving of the attenuated sounding signal occurs during the drilling operation.

15. The system of claim 12, the non-transitory computer-readable storage medium having additional instructions stored which, when executed by the processor, cause the processor to perform operations comprising initializing the equalizer based on the comparison.

16. The system of claim 12, the non-transitory computer-readable storage medium having additional instructions stored which, when executed by the processor, cause the processor to perform operations comprising:

generating a link margin frequency map using the comparison;

determining a communication channel bandwidth based on the link margin frequency map; and selecting modulation parameters for a communication channel based on the link margin frequency map.

17. The system of claim 16, wherein the modulation parameters comprise a modulation scheme, the modulation scheme being one of BPSK, QPSK, 8PSK, QAM, PSK, CPM, SOQPSK, MSK, and a variant of at least one of BPSK, QPSK, 8PSK, QAM, PSK, CPM, SOQPSK, and MSK.

18. The system of claim 12, the computer-readable storage medium having additional instructions stored which, when executed by the processor, cause the processor to perform operations comprising shifting the attenuated sounding signal after receiving the attenuated sounding signal.

19. The system of claim 18, wherein the shifting of the attenuated sounding signal is a frequency down-conversion.

20. The system of claim 12, wherein the first location is approximately at a surface location of the wellbore and the second location is at a downhole location of the wellbore.

21. The method of claim 12 wherein the communication path is a mud column.

22. A non-transitory computer-readable storage device having instructions stored which, when executed by a computing device in a drilling operation, cause the computing device to perform operations comprising:

identifying a frequency range for sounding a communication path between a first device at a first location within a wellbore and a second device at a second location within the wellbore;

generating a sounding signal being continuous in time and non-contiguous in frequency with the second device by:

assigning a center frequency, a bandwidth, and a timeframe to each of a plurality of sounding sequences, such that an entirety of the frequency range is assigned to the plurality of sounding sequences, and wherein the bandwidths assigned to at least two of the plurality of sounding sequences are configured to overlap, and playing the plurality of sounding sequences in order according to the timeframe assigned to each sounding sequence in the plurality of sounding sequences; transmitting the sounding signal through the communication path to produce an attenuated sounding signal;

receiving, at the first device, the attenuated sounding signal;

comparing the attenuated sounding signal to the sounding signal, to yield a comparison, wherein the comparison is used to estimate a transfer function for channel mapping and to initialize an equalizer to reduce distortion effect of frequency selective fading in the drilling operation; and estimating the transfer function of the communication path based on the comparison.

23. The method of claim 22 wherein the communication path is a mud column.

* * * * *